US011346160B2

(12) United States Patent
Miller et al.

(10) Patent No.: US 11,346,160 B2
(45) Date of Patent: May 31, 2022

(54) WALKING SYSTEM FOR A COMPLETION OR WORKOVER RIG

(71) Applicant: Ranger Energy Services, LLC, Houston, TX (US)

(72) Inventors: Harold James Miller, Calgary (CA); Ivan Amic, Calgary (CA); Jason Brent Schroeder, Edmonton (CA); Christopher Jason Serran, Calgary (CA)

(73) Assignee: RANGER ENERGY SERVICES, LLC, Houston, TX (US)

( * ) Notice: Subject to any disclaimer, the term of this patent is extended or adjusted under 35 U.S.C. 154(b) by 60 days.

(21) Appl. No.: 16/773,464

(22) Filed: Jan. 27, 2020

(65) Prior Publication Data

US 2020/0240218 A1 Jul. 30, 2020

Related U.S. Application Data

(60) Provisional application No. 62/798,718, filed on Jan. 30, 2019.

(51) Int. Cl.
*E21B 15/00* (2006.01)
*E21B 19/14* (2006.01)
*E21B 7/02* (2006.01)

(52) U.S. Cl.
CPC ..... *E21B 15/003* (2013.01); *E21B 7/02* (2013.01); *E21B 19/14* (2013.01)

(58) Field of Classification Search
CPC ..... E21B 15/003; E21B 7/02; E21B 7/023; E21B 19/14
See application file for complete search history.

(56) References Cited

U.S. PATENT DOCUMENTS

| | | | | |
|---|---|---|---|---|
| 6,581,525 | B2 * | 6/2003 | Smith | E21B 15/003 104/96 |
| 6,966,106 | B1 * | 11/2005 | Roodenburg | E21B 19/14 166/75.11 |
| 9,518,429 | B2 * | 12/2016 | Fortson | B62D 57/022 |
| 9,951,539 | B2 * | 4/2018 | Roodenburg | E04H 12/187 |
| 10,472,892 | B1 * | 11/2019 | Conn, III | E21B 7/022 |
| 2003/0172599 | A1 | 9/2003 | Frink | |
| 2013/0341096 | A1 | 12/2013 | Flusche | |
| 2015/0315861 | A1 * | 11/2015 | Zachariasen | E21B 19/083 166/385 |
| 2016/0186495 | A1 * | 6/2016 | Flusche | B62D 57/032 180/8.6 |
| 2018/0363834 | A1 * | 12/2018 | Clarke | E21B 15/006 |
| 2020/0018123 | A1 * | 1/2020 | Evans | E21B 15/003 |

OTHER PUBLICATIONS

Canadian Examiner's Report—Application Serial No. 3,066,800.

* cited by examiner

*Primary Examiner* — Nicole Coy
(74) *Attorney, Agent, or Firm* — Scott Griggs; Griggs Bergen LLP

(57) ABSTRACT

A walking system for a workover rig or completion rig mounted on a motor vehicle. The walking system includes a main platform having ramps and tracks for the motor vehicle to drive up onto and a base beam extending perpendicularly on both sides of the main platform to act as outriggers for stability. The system further includes a workstring platform for storing tubulars that make up the workstring, which is elevated above a wellhead. The main platform and base beam have walking assemblies for lifting the rig and moving it laterally so that it can be positioned over the wellhead for workover or completion operations.

10 Claims, 23 Drawing Sheets

WALKING SYSTEM FOR A COMPLETION OR WORKOVER RIG

PRIORITY STATEMENT & CROSS-REFERENCE TO RELATED APPLICATION

This application claims priority from U.S. Patent Application Ser. No. 62/798,718 entitled "Walking System for a Completion or Workover Rig" filed on Jan. 30, 2019, in the names of Harold James Miller et al., which is hereby incorporated by reference, in entirety, for all purposes.

TECHNICAL FIELD OF THE INVENTION

The present disclosure is related to the field of oil and gas well completions and workovers, in particular, a system for moving an entire completion or workover rig and workstring without disassembling the rig or laying down the workstring.

BACKGROUND OF THE INVENTION

It is typical for a number of oil and gas wells to be drilled from a central location, known as a "well pad" in order to reduce the footprint of multiple well locations and make the overall well construction process more efficient. After each well is drilled, it must be "completed" in order for production of oil or gas to begin. After production has commenced, it is common that the wells may need a "workover" to enhance production and/or repair a subsurface problem. A typical completions/workover rig moves tools and equipment in and out of the well by assembling or disassembling a workstring in sections that can be contained in a rack rather than laying each joint down each time. It is much more time efficient to store the workstring vertically in the rack than lay each piece down.

When working on a well pad, each well is in relatively close proximity. In most cases, when a completions/workover rig moves from one well to another on a well pad, the workstring must be completely dismantled and laid down, the rig must be rigged out, moved, and rigged back up, and the workstring picked back up and re-assembled. Laying down and picking up the workstring, as well as the rig out and rig up of the rig are high risk operations that lead to personnel injuries and damaged equipment. Typical completions/workover rigs have a series of guy-lines that attach to the mast and the racking board to provide stability to resist forces in the mast due to wind loading and hoisting loads. The guy-lines are either attached to ground anchors or to outriggers in a specified pattern.

It is, therefore, desirable to provide a system that enables the rig and workstring to be moved from one well to another with the rig standing and the workstring stored vertically.

SUMMARY OF THE INVENTION

A system for moving the completions/workover rig and vertically stored workstring without dismantling is provided. The system can comprise of a platform that can be placed in a position relative to the first well to be completed or worked over on a pad prior to the completions/workover rig. The rig can be initially rigged up on top of the platform, and the workstring can be picked up and assembled in order to complete or workover the first well. The platform can include a ramp incorporated on one end that the rig can back up onto in addition to outriggers that are designed to act as guy-line anchors to counteract mast over-turning loads, as well as a stand with a racking system where the workstring can be stored vertically. It is critical to ensure that the loads imparted on the mast do not exceed the design loading of the rig which is known by comparing to the maximum allowable wind loading. The outriggers can move with the entire system; therefore, the mast loading is acceptable.

Typically, when a completions/workover rig pulls the workstring from a well, it is racked in sections and set on the ground on the side of the wellhead that is opposite the main rig. The workover rig walking system can comprise a platform that the workstring can be set on that keeps the workstring elevated so that as the rig can move away from the well, the workstring will not interfere with the wellhead. A lower racking system that can be actuated hydraulically can be deployed prior to moving the platform that stabilizes the workstring to counteract acceleration forces and minimize the loads that would be transferred into the rig. The lower racking system can comprise a series of pipe clamps that can be folded to a stand-by position during conventional workover operations. The pipe clamps can be folded into place as the workstring is being pulled out of the well the last time before a rig move. Once all of the workstring is in place, the lower racking system can be raised hydraulically to a point that will optimize its effectiveness, and then the clamps can be squeezed onto the workstring. Telescoping cross braces can be attached to the lower racking area and to the main beam of the workover rig walking system to provide stabilization and to minimize the forces of acceleration transferred into the mast during walking operation.

The platform can comprise outriggers that act as guy-line anchors to counteract mast over-turning loads when the rig is being operated and when the rig is being moved between wells. The platform can comprise a number of walking assemblies that can lift the complete platform, rig and workstring and then move it in a linear direction. The walking assemblies can be turned in order to move the platform in the desired direction. The walking assemblies can be controlled with a system to ensure that vertical movement is equal to keep the platform level, and to keep the rig and workstring vertical while being lifted. The control system can also be deployed to ensure that horizontal movement is coordinated, and to minimize acceleration loads.

In some embodiments of the system, an isolation system can be utilized between the upper workstring rack and the rigs hoisting mast that can minimize acceleration loads being transferred into the mast from the movement of the workstring.

Broadly stated, in some embodiments, a walking system can be provided for a workover rig or completion rig for use on a wellhead with a workstring assembled from a plurality of tubulars, the workover rig or completion rig disposed on a motor vehicle, the workover rig or completion rig further comprising a mast and an upper racking board, the walking system comprising: a main platform comprising vehicle tracks configured for the motor vehicle to travel along; ramps disposed at a first end of the main platform, the ramps operatively coupled to the vehicle tracks, the ramps configured for the motor vehicle to travel up the ramps onto the vehicle tracks; a set back platform disposed at a second end of the main platform, the set back platform comprising an elevated workstring platform wherein the elevated workstring platform is configured for storing the plurality of tubulars in combination with the upper racking board; a base beam disposed on the main platform between the first end and the second end of the main platform, the base beam comprising one end extending substantially perpendicularly from one side of the main platform, the base beam further comprising an opposing end extending substantially perpendicularly from an opposing side of the main platform; and a plurality of walking assemblies disposed on the main platform and the base beam, the plurality of walking assemblies configured to raise the combination of the walking system and the rig and move said combination in a lateral direction.

Broadly stated, in some embodiments, the elevated workstring platform can further comprise front supporting members and rear supporting members operatively coupled the elevated workstring platform to the main platform and the base beam, the front and rear supporting members configured to support the elevated workstring platform at a height above the wellhead.

Broadly stated, in some embodiments, each of the ends of the base beam can comprise a guy anchor configured for anchoring guy-lines from the mast and from the upper racking board.

Broadly stated, in some embodiments, each of the plurality of walking assemblies can comprise: a mounting flange operatively coupled to the main platform; a lifting cylinder, an upper end of the lifting cylinder operatively coupled to the mounting flange; a walking foot, the walking foot comprising a roller raceway; a roller assembly operatively coupled to a lower end of the lifting cylinder; and a shift cylinder operatively coupling the roller assembly to the walking foot, wherein the roller assembly travels along the roller raceway when the shift cylinder extends and retracts.

Broadly stated, in some embodiments, the walking system can further comprise: at least one racking board isolator disposed on the upper racking board; at least one mast isolator disposed on the mast; and a coupler operatively coupling the at least one racking board isolator to the at least one mast isolator.

Broadly stated, in some embodiments, one or both of the at least one racking board isolator and the at least one mast isolator can comprise one or more of a spring, a damper and a spring-damper combination.

Broadly stated, in some embodiments, the elevated workstring platform can comprise a pipe stabilization system, comprising: a clamp frame; a plurality of workstring clamps configured to receive one or more of the tubulars; and a plurality of clamping cylinders operatively coupling the plurality of workstring clamps to the clamp frame, the plurality of clamping cylinders configured to tighten to clamp the tubulars to the clamp frame, the plurality of clamping cylinders further configured to loosen wherein the tubulars are released from the plurality of workstring clamps.

Broadly stated, in some embodiments, the clamp frame can further comprise a plurality of frame cylinders configured to raise and lower the clamp frame relative to the elevated workstring platform.

Broadly stated, in some embodiments, the walking system can further comprise a plurality of leveling cylinders configured for leveling the main platform and the base beam.

DETAILED DESCRIPTION OF THE INVENTION

In this description, references to "one embodiment", "an embodiment", or "embodiments" mean that the feature or features being referred to are included in at least one embodiment of the technology. Separate references to "one embodiment", "an embodiment", or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments but is not necessarily included. Thus, the present technology can include a variety of combinations and/or integrations of the embodiments described herein.

Figure 1:
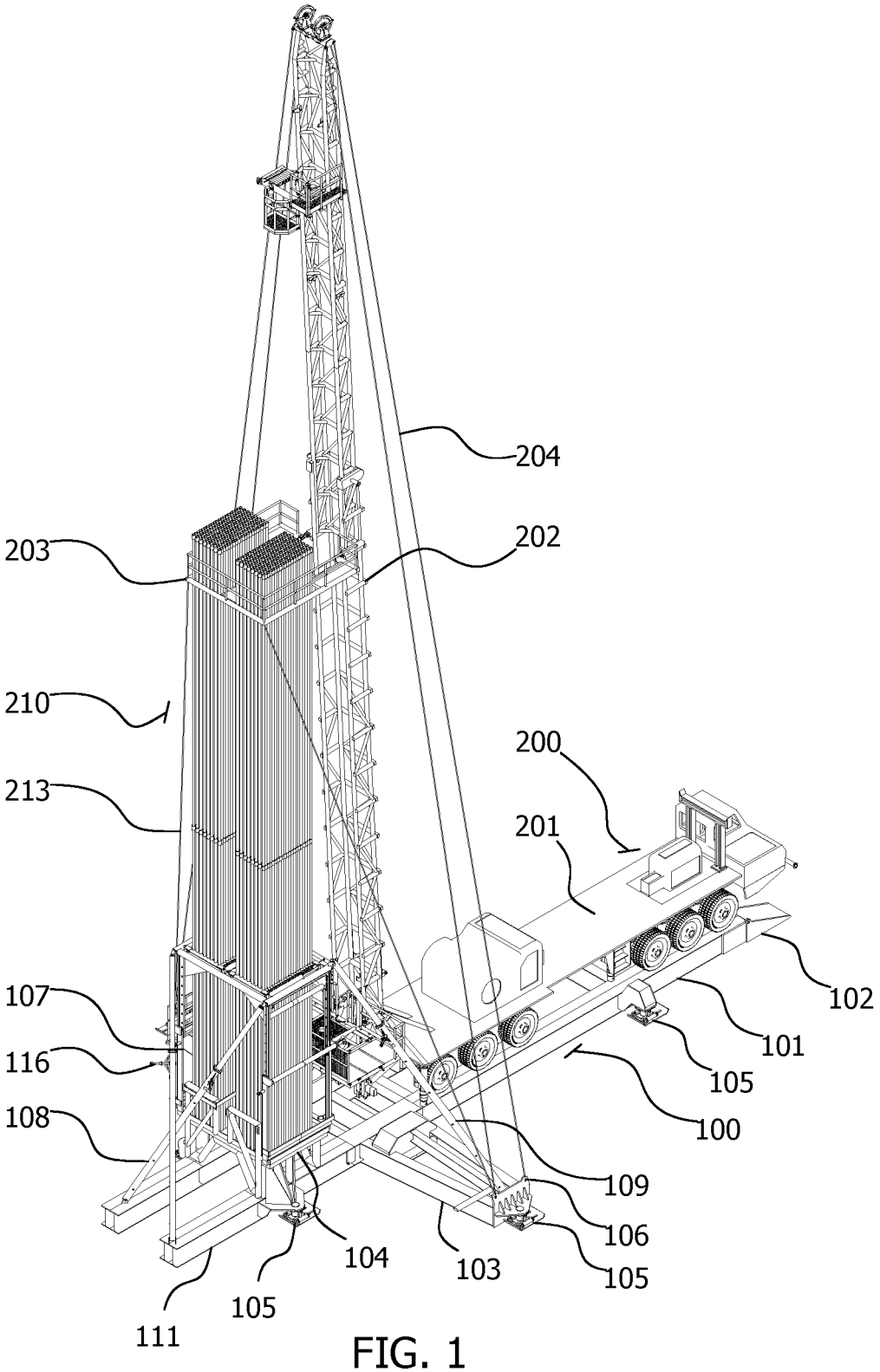
FIG. 1 is an isometric view depicting one embodiment of a workover rig walking system with the workover rig and the workstring shown.

Referring to FIG. 1, one embodiment of workover rig walking system 100 is shown with workover rig 200 in place for carrying out a workover operation, wherein workover rig 200 comprises motor vehicle 201. For the purposes of this specification and the claims that follow, the term "workover rig" shall be interpreted as meaning a "workover rig" or a "completion rig" as described above. In some embodiments, workover rig walking system 100 can be comprised of a number of subcomponents that can comprise of main platform 101, ramps 102, base beam 103, setback platform 111 and elevated workstring platform 104. In some embodiments, ramps 102 can be disposed on one end of vehicle tracks 10 wherein the combination of tracks 10 and ramps 102 can be configured for motor vehicle 201 to travel up ramps 102 onto vehicle tracks 10. In some embodiments, workstring 210 can be supported by elevated workstring platform 104 and held vertical by upper racking board 203 disposed on mast 202. Workstring 210 can comprise a plurality of jointed tubulars as well known to those skilled in the art. In some embodiments, workover rig walking system 100 can comprise a plurality of walking assemblies 105 that can be used to elevate workover rig walking system 100 and move it horizontally. Mast guy-lines 204 and upper racking board guy-lines 213 can provide stabilization of workover rig 200 and counteract wind loads and accelerations due to the movement of workstring 210 racked in upper racking board 203. Mast guy-lines 204 can be anchored to guy anchor 106 on the ends of base beam 103. Rear supporting members 108 and front supporting members 109 can provide additional stability to clamp frame 107 and workstring 210 and, thus, can aid in said counteracting wind loads and accelerations.

Figure 2:
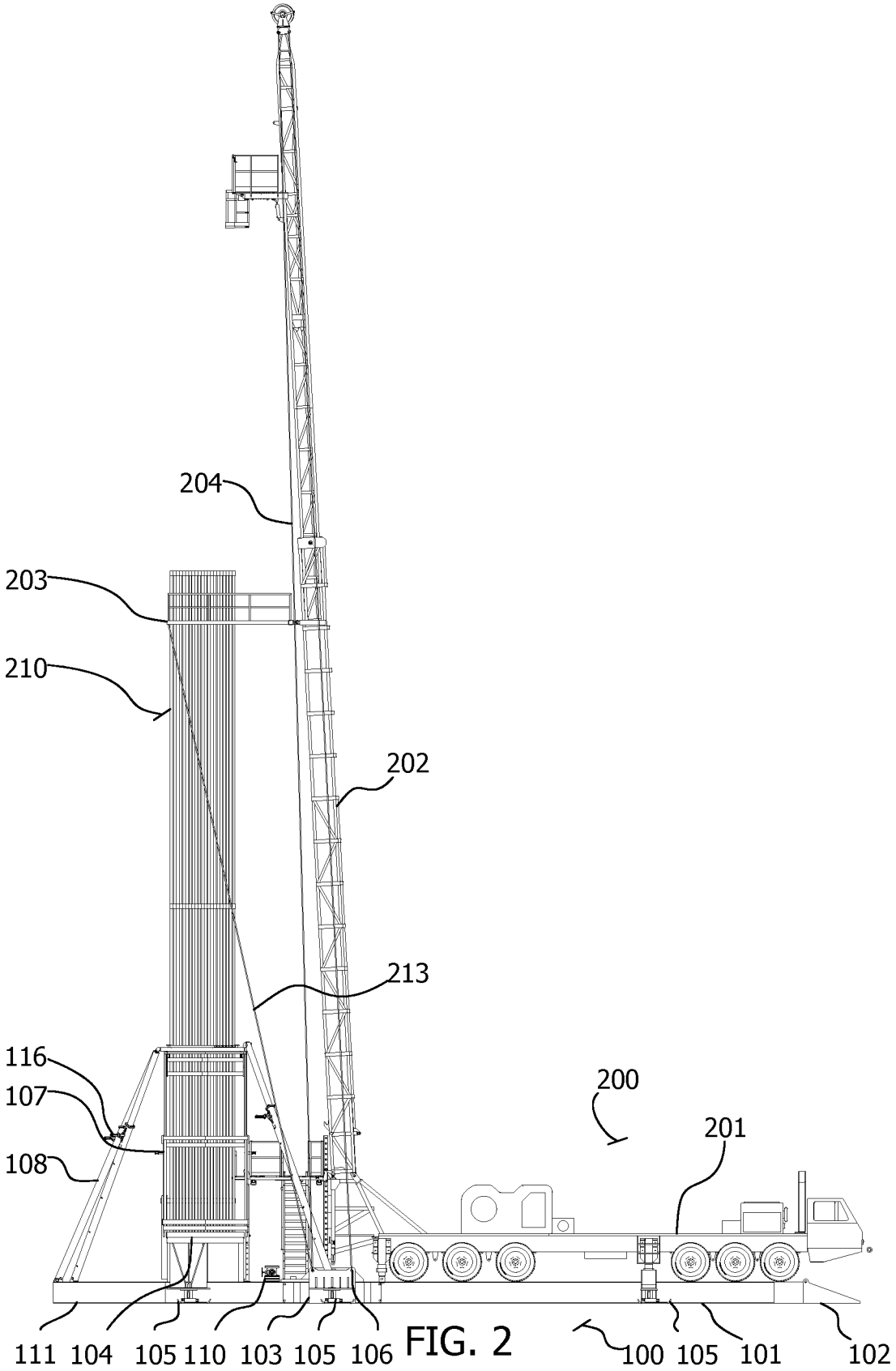
FIG. 2 is a side elevation view depicting the workover rig walking system of FIG. 1.
Figure 3:
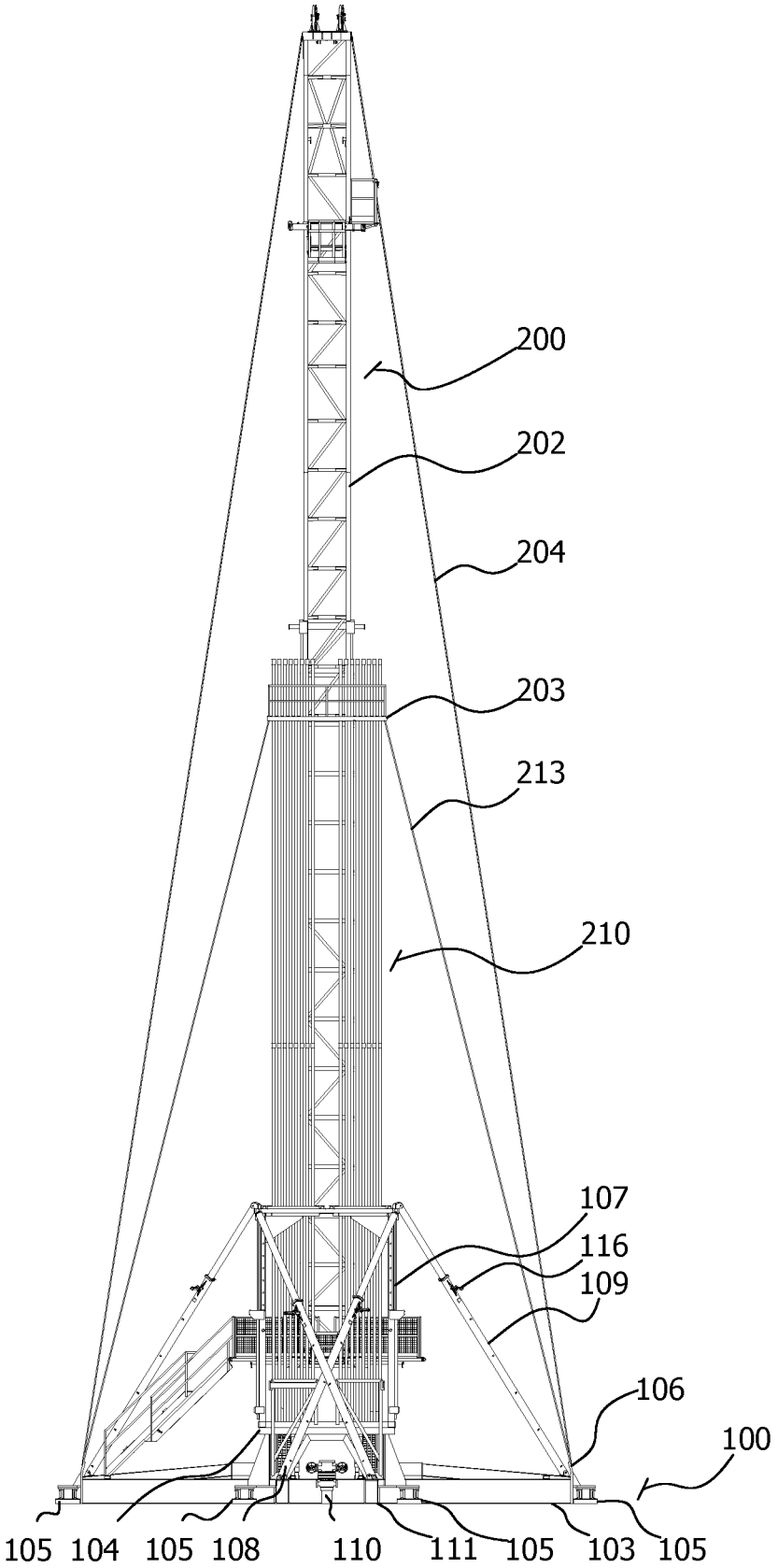
FIG. 3 is an end elevation view depicting the workover rig walking system of FIG. 1.

FIGS. 2 and 3 are side and end elevation views, respectively, depicting the embodiment of workover rig walking system 100 shown in FIG. 1 with workover rig 200 and workstring 210 shown.

Figure 4:
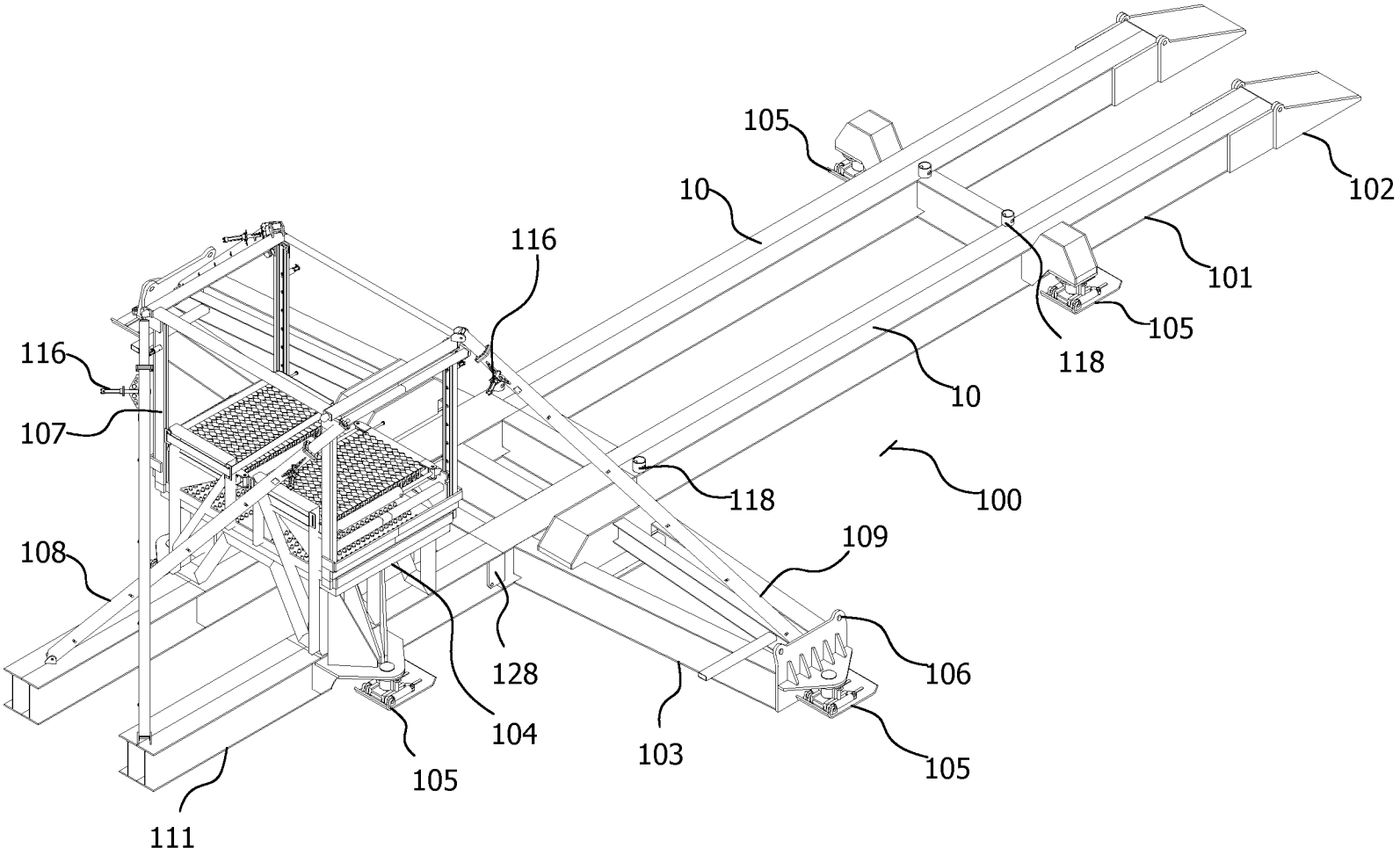
FIG. 4 is an isometric view depicting one embodiment of a workover rig walking system.

FIG. 4 depicts an isometric view of one embodiment of the structure of workover rig walking system 100 prior to workover rig 200 backing onto main platform 101. In some embodiments, ramps 102 can be unfolded to provide a means for workover rig 200 to drive up onto main platform 101.

Figure 5:
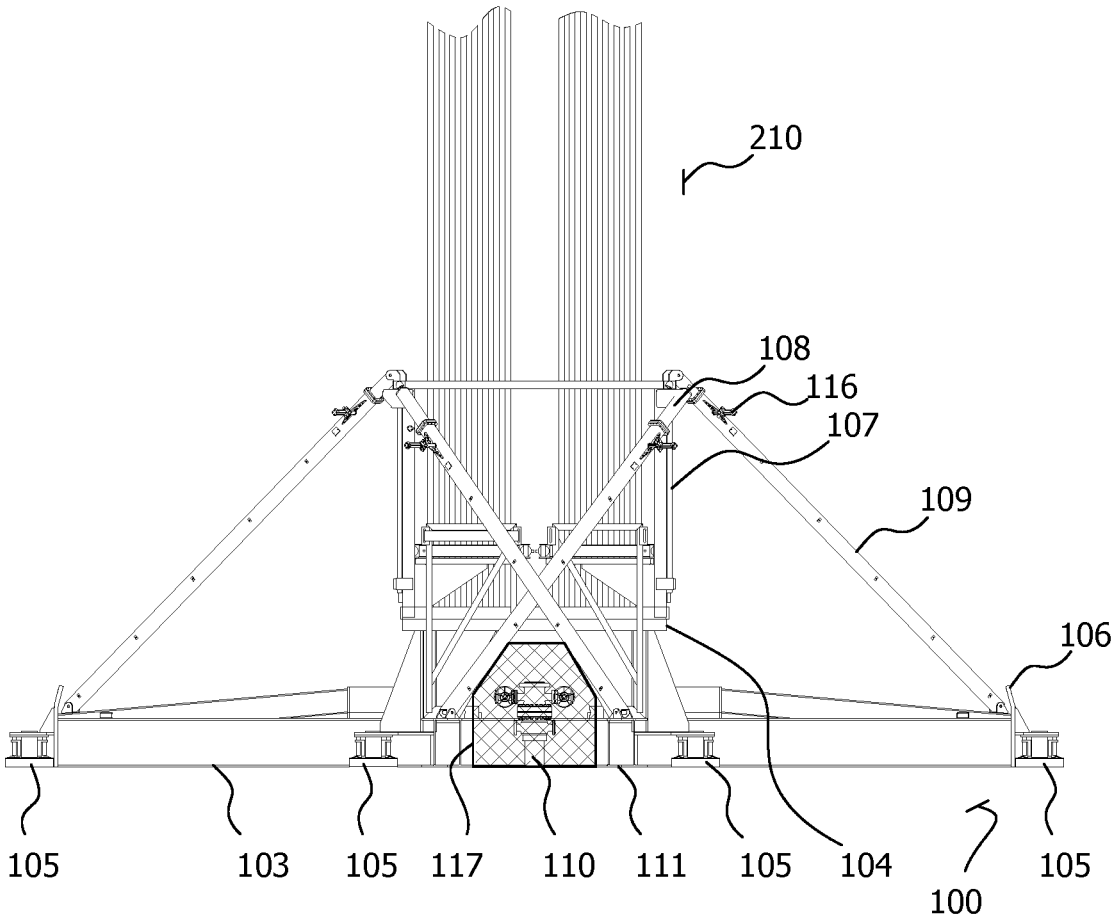
FIG. 5 is an end elevation view depicting the workover rig walking system of FIG. 4 in passive mode.
Figure 6:
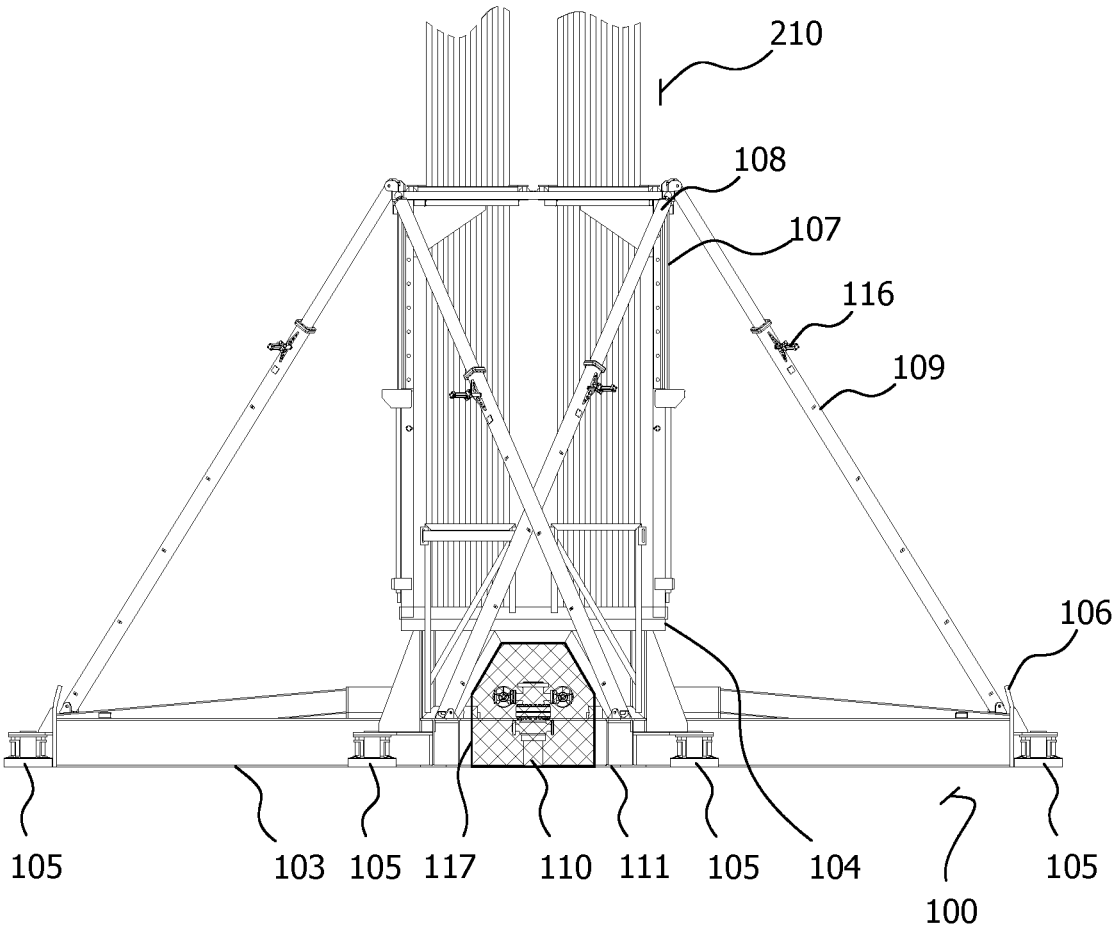
FIG. 6 is an end elevation view depicting the workover rig walking system of FIG. 4 in walking mode.
Figure 7:
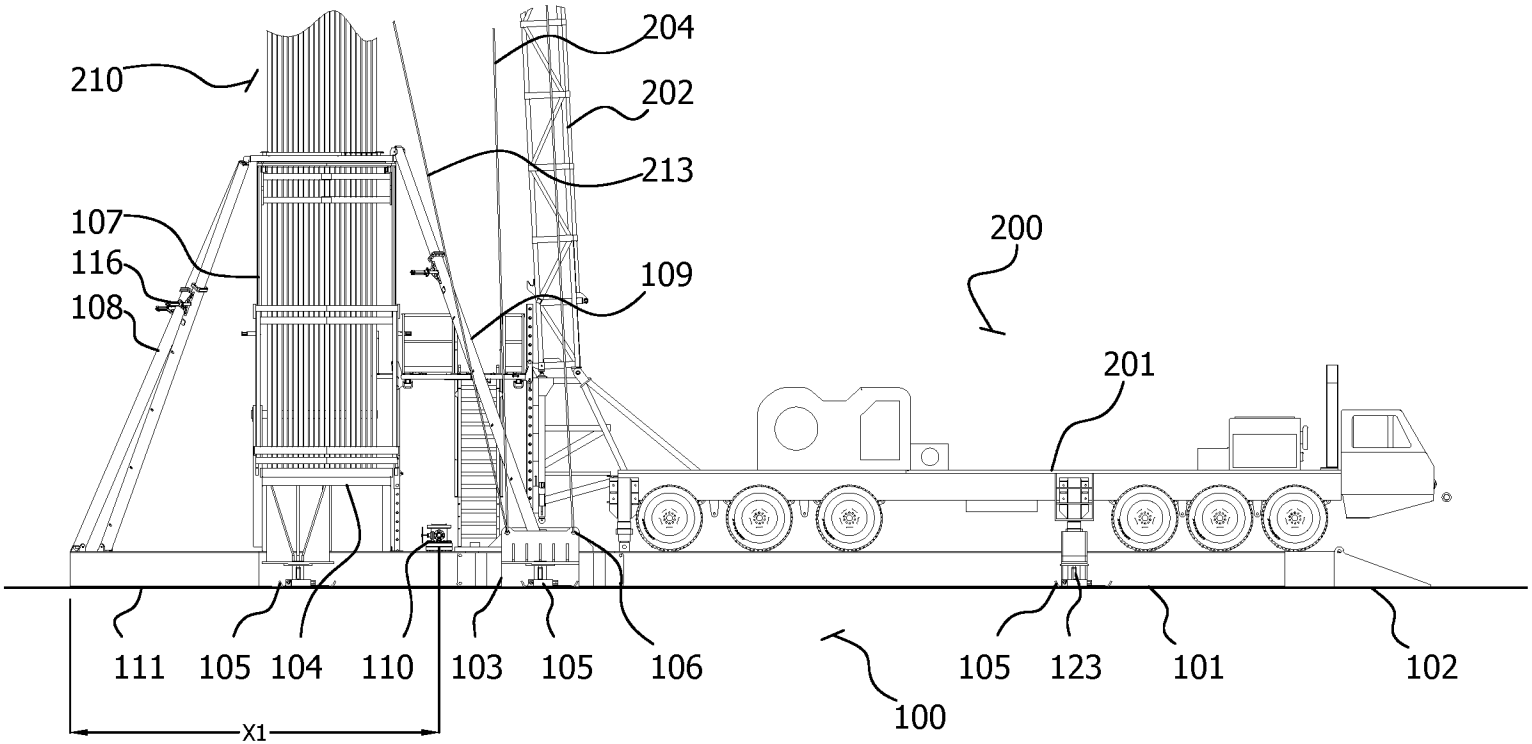
FIG. 7 is a side elevation view depicting the workover rig walking system of FIG. 1 prepared for walking.

FIGS. 5 and 6 are end elevation views depicting one embodiment of workover rig walking system 100 with workstring 210 shown. In some embodiments, elevated workstring platform 104 can support workstring 210 at a height that creates walk-over space 117 so that elevated workstring platform 104 can pass over wellhead 110 when workover rig walking system 100 and workover rig 200 is moved horizontally.

In some embodiments, clamp frame 107, as shown in FIG. 5, can be deployed at a height to be used during normal operation of workover rig 200, whereas, as shown in FIG. 6, clamp frame 107 can be deployed at a height to stabilize workstring 210 during horizontal movement of workover rig walking system 100. Once clamp frame 107 is at the proper height, telescoping supporting members 108 and 109 can be locked with actuators 116 to provide stabilization thereto.

Figure 8:
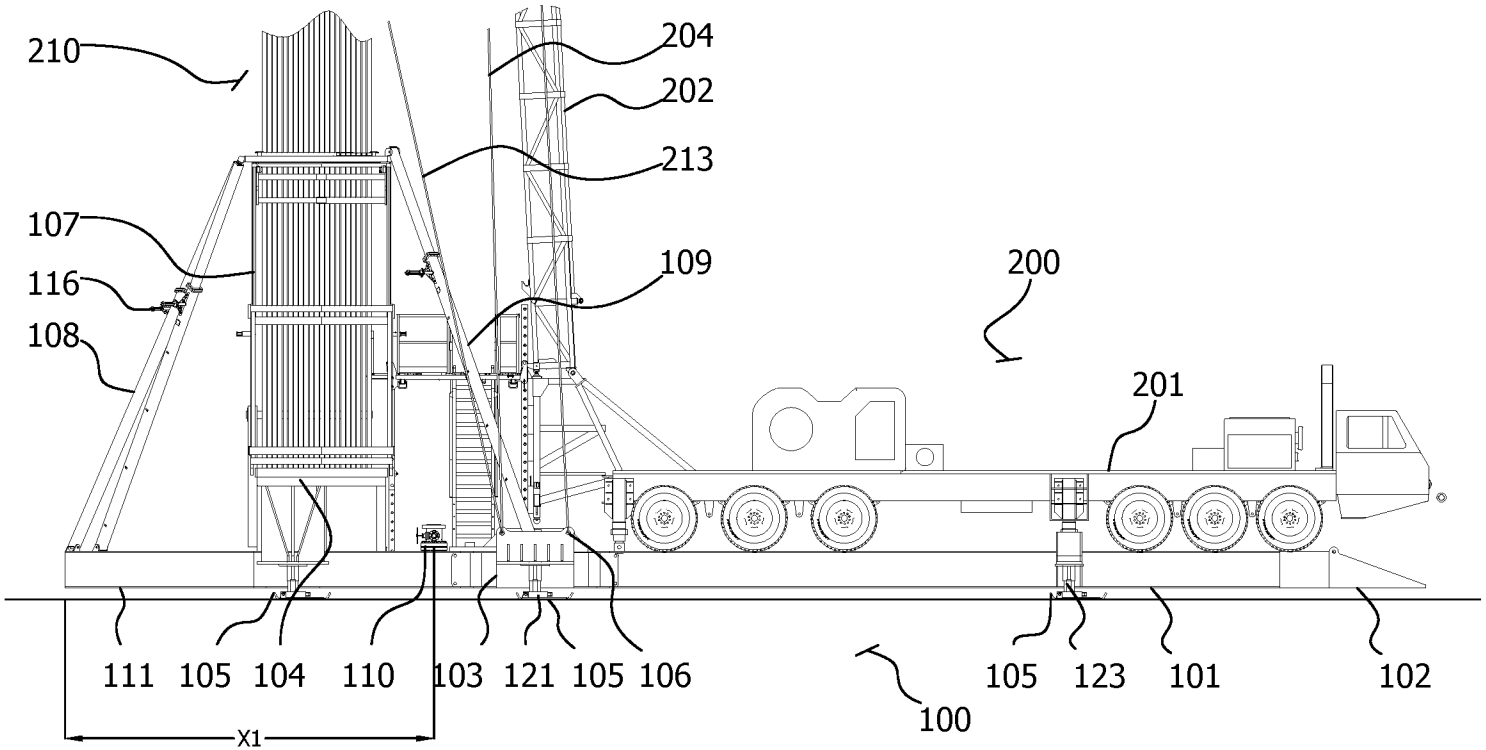
FIG. 8 is a side elevation view depicting the workover rig walking system of FIG. 7 with the workover rig and the workstring shown lifted off the ground.

In some embodiments, the plurality of walking assemblies 105 can be deployed to linearly move workover rig walking system 100 in a horizontal manner as shown in FIGS. 7 to 12. In some embodiments, system 100 can be first raised a vertical distance, as shown in FIG. 8, by means of lift cylinder 123, as shown in FIGS. 13A to 13D. The plurality of lift cylinders 123 can be actuated and controlled in order to maintain workover rig walking system 100 in a flat plane parallel to the ground.

Figure 9:
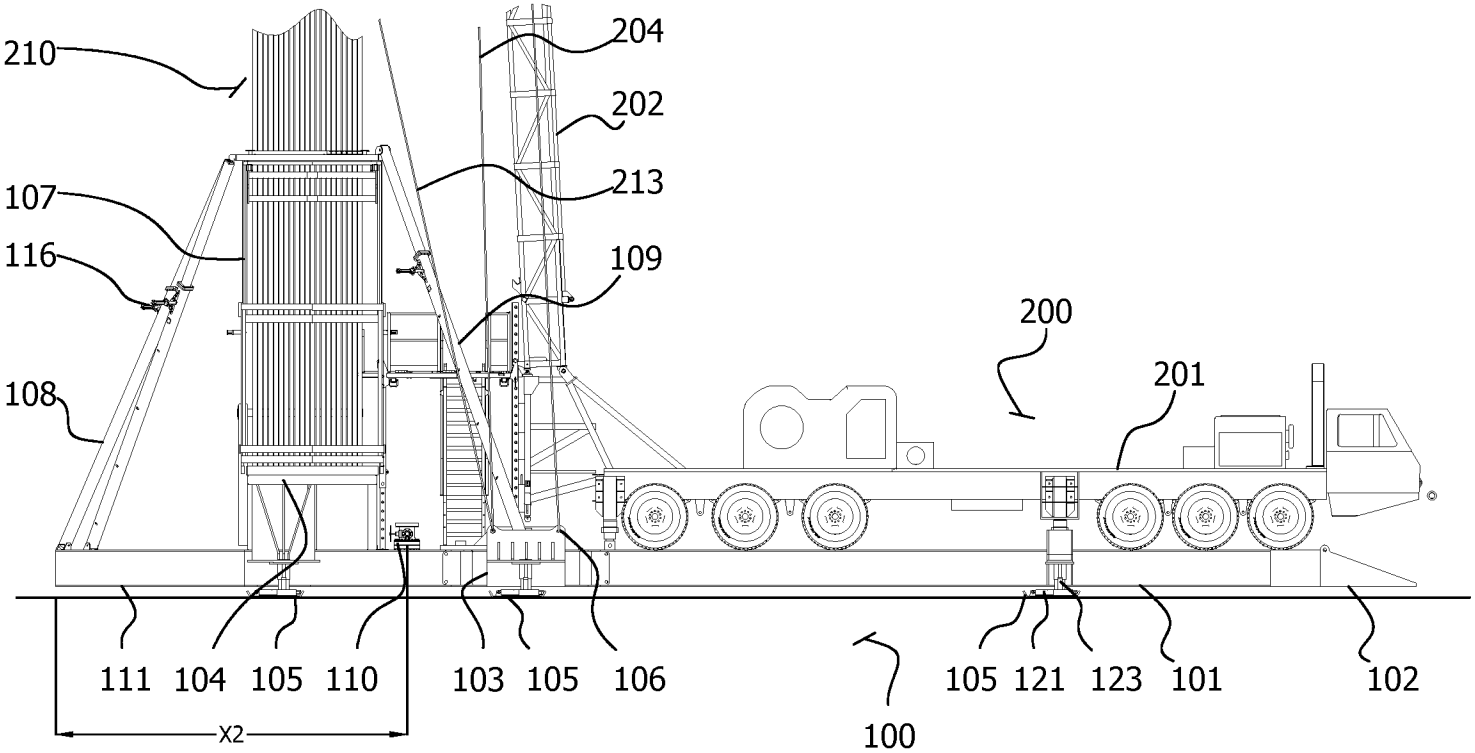
FIG. 9 is a side elevation view depicting the workover rig walking system of FIG. 8 with the workover rig and the workstring shown walked forward one step.
Figure 10:
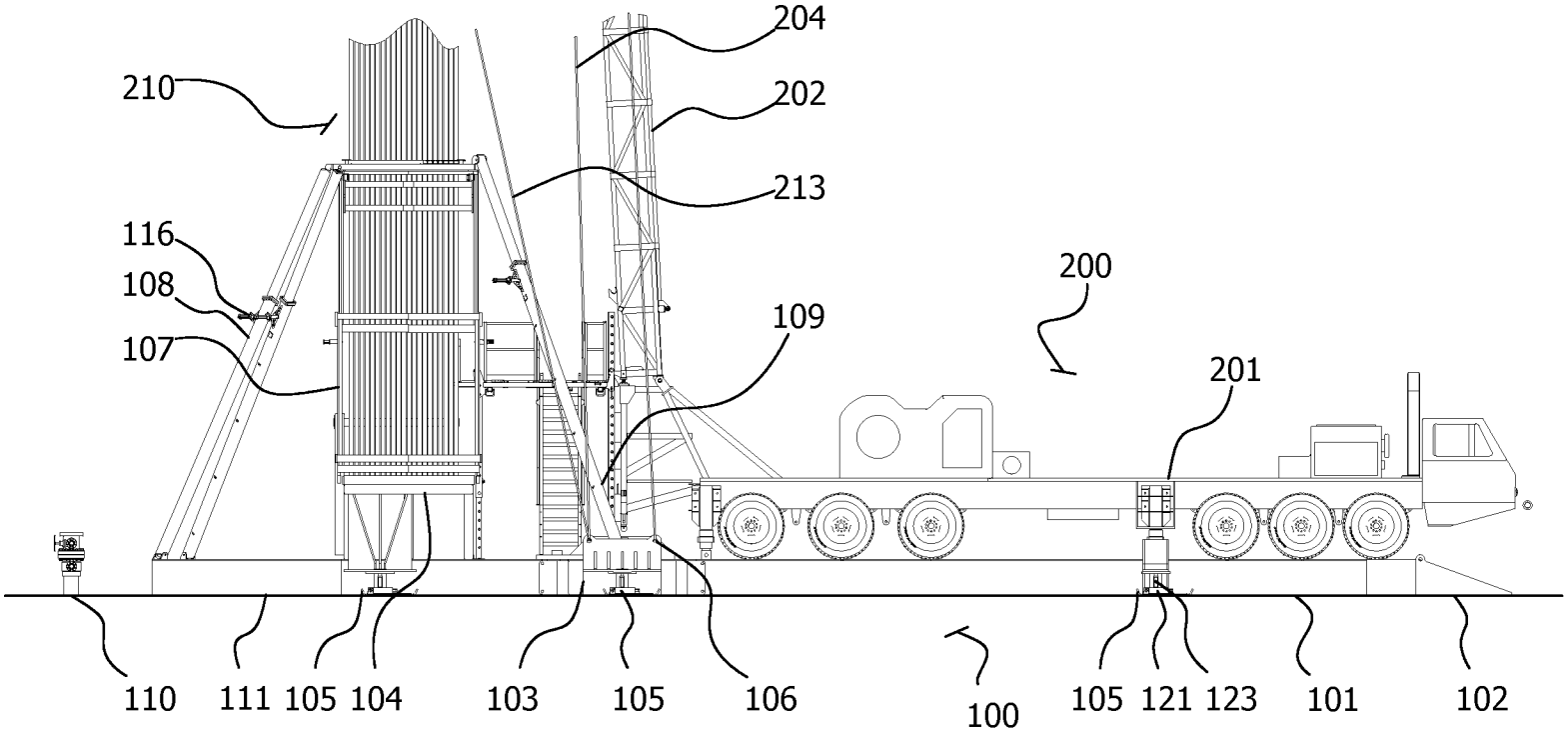
FIG. 10 is a side elevation view depicting the workover rig walking system of FIG. 9 with the workover rig and the workstring shown walked forward until the back end is beyond the wellhead.
Figure 11:
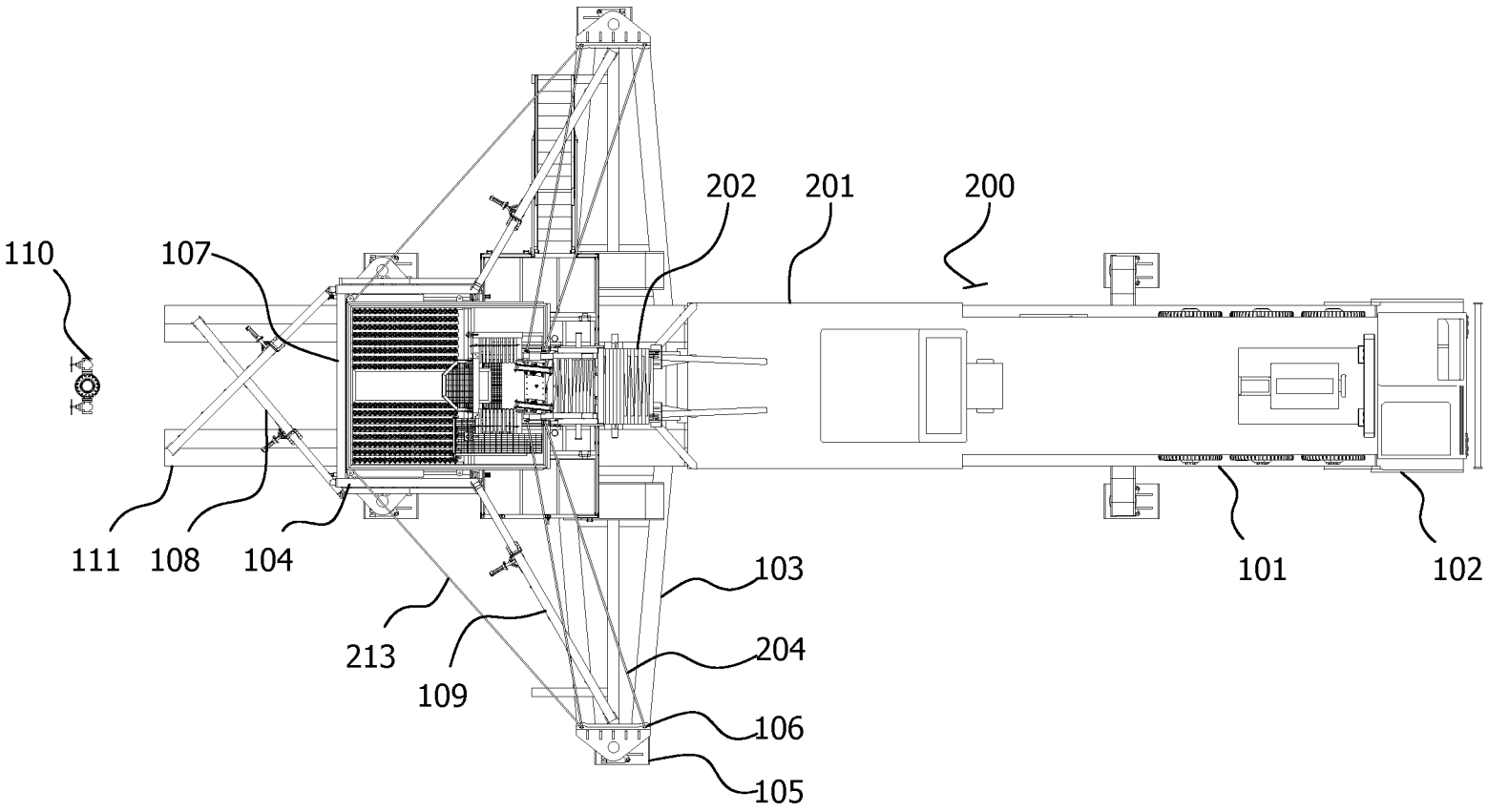
FIG. 11 is a top plan view depicting the workover rig walking system of FIG. 10.

Upon successfully raising workover rig walking system 100 by lift cylinders 123, system 10 can then traverse in a horizontal direction by actuation of shift cylinders 121. FIG. 9 illustrates one embodiment of a complete linear motion in the horizontal direction, whereas distance X2 in FIG. 9 is less than distance X1 shown in FIG. 8 by the amount of stroke in shift cylinders 121. Consecutive, repeated cycling of lift cylinders 123 and shift cylinders 121 can result in a movement of workover rig walking system 100 beyond wellhead 110 as shown in FIGS. 10 and 11.

Figure 12:
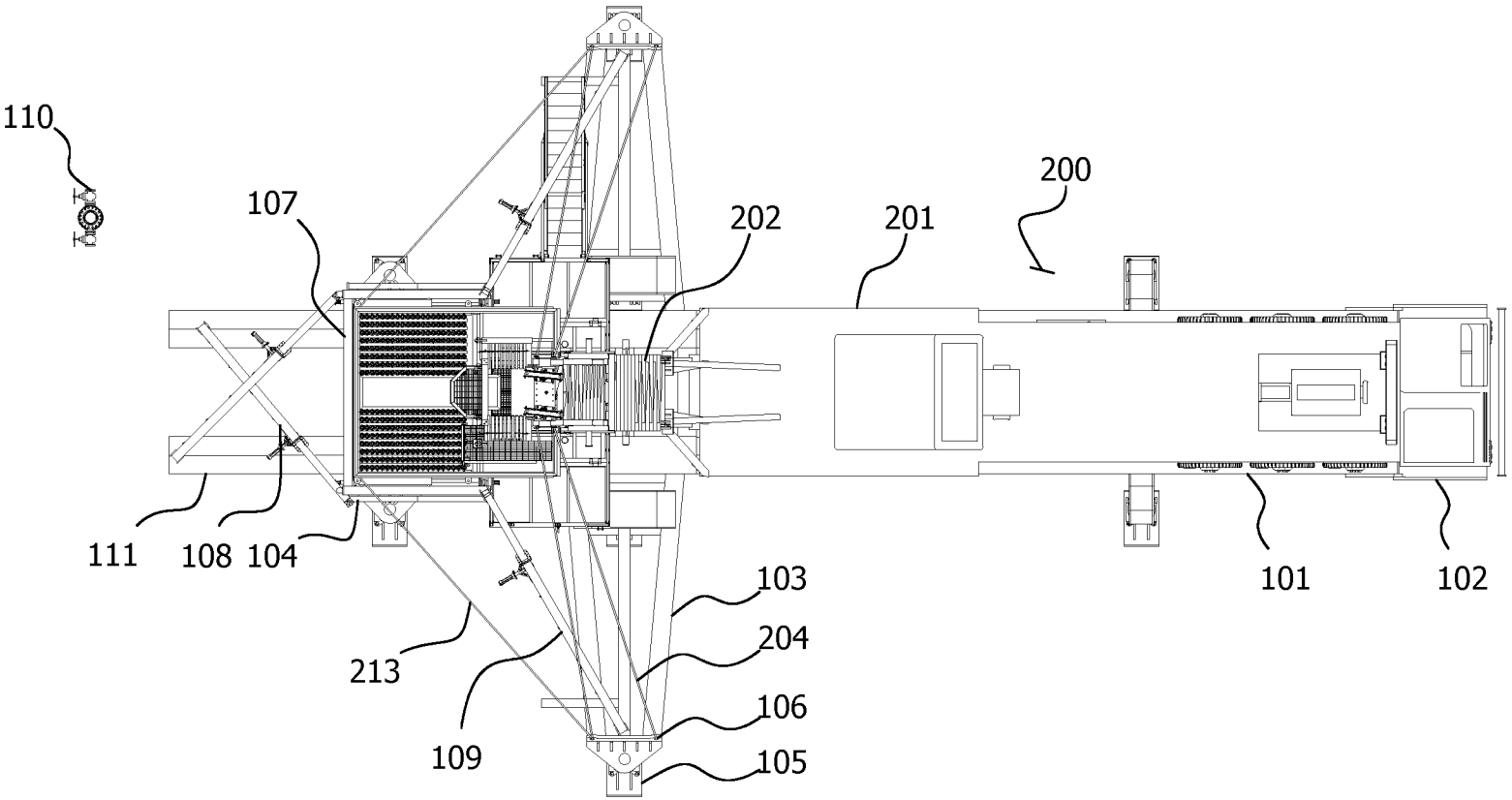
FIG. 12 is a top plan view depicting the workover rig walking system of FIG. 11 with the workover rig and the workstring shown walked transversely.
Figure 13A:
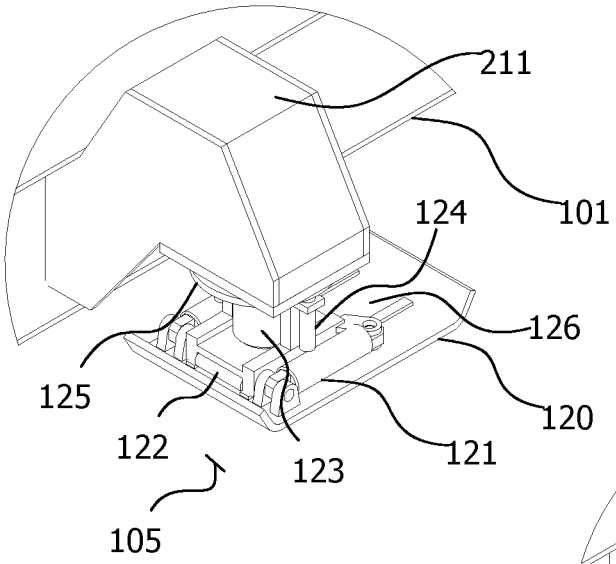
FIG. 13A is an isometric view depicting one embodiment of a lifting/walking apparatus aligned for linear movement and the lift cylinder retracted.
Figure 13B:
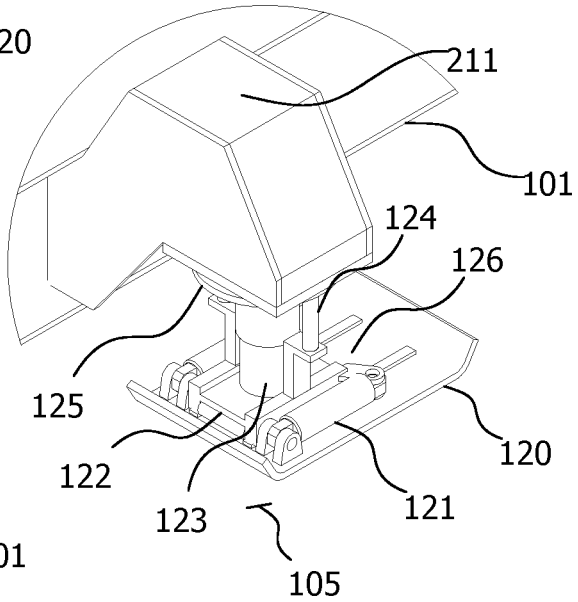
FIG. 13B is an isometric view depicting the lifting/walking apparatus of FIG. 13A aligned for linear movement and the lift cylinder extended.
Figure 13C:
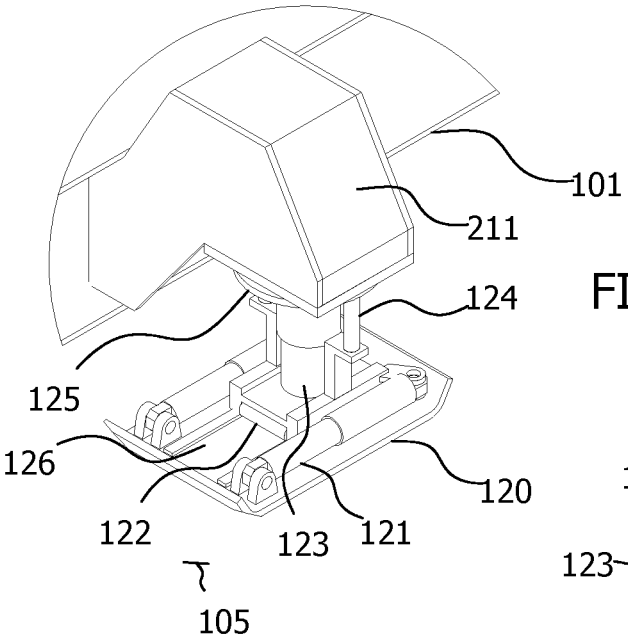
FIG. 13C is an isometric view depicting the lifting/walking apparatus of FIG. 13B aligned for linear movement and the lift cylinder and shift cylinders extended.
Figure 13D:
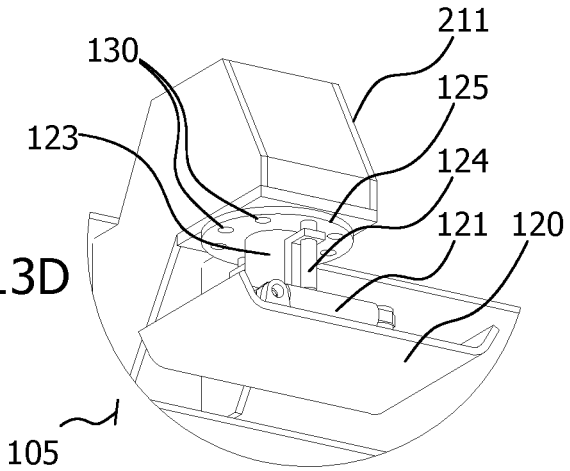
FIG. 13D is an isometric view depicting the lifting/walking apparatus of FIG. 13A that illustrates the system that allows the angle of the linear movement to be changed and locked into place.
Figure 14A:
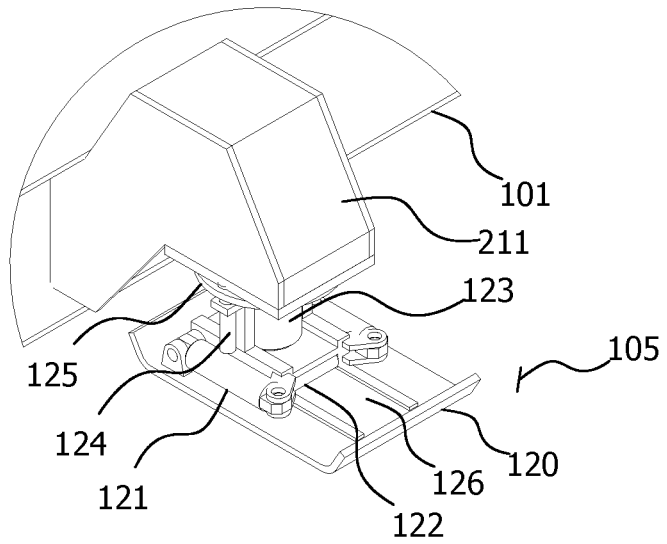
FIG. 14A is an isometric view depicting the lifting/walking apparatus of FIG. 13A aligned for transverse movement and the lift cylinder retracted.
Figure 14B:
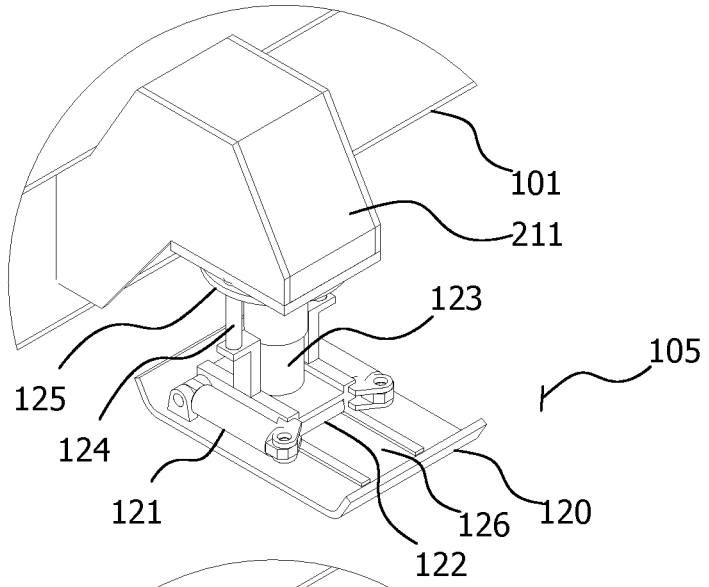
FIG. 14B is an isometric view depicting the lifting/walking apparatus of FIG. 14A aligned for transverse movement and the lift cylinder extended.
Figure 14C:
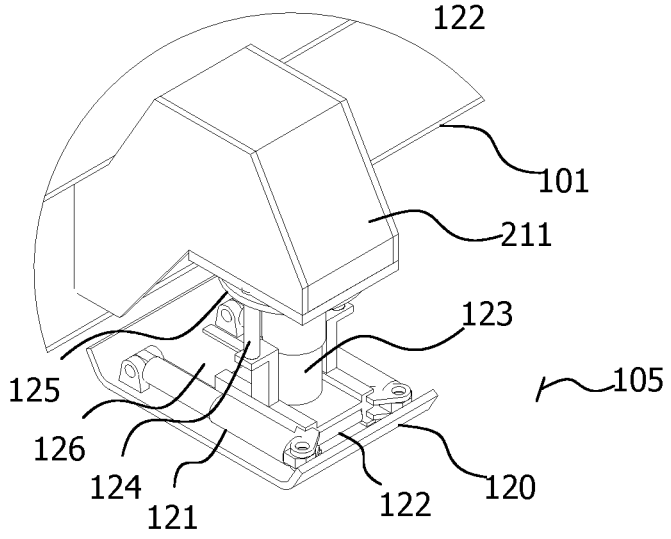
FIG. 14C is an isometric view depicting the lifting/walking apparatus of FIG. 14B aligned for transverse movement and the lift cylinder and shift cylinders extended.

In some embodiments, walking assemblies 105 can comprise the capability to be rotated about the axis of lift cylinder 123, as illustrated in FIGS. 13 and 14. Removing locking pins 124 allow walking foot 120, shift cylinders 121, roller assembly 122 and roller raceway 126 to be rotated and locked back in place thereby allowing workover rig walking system 100 to travel in a transverse direction at a specified angle to the initial linear motion. In some embodiments, walking assemblies 105, as shown in FIGS. 14A to 14*c*, can allow the movement of workover rig walking system 100 to be perpendicular to the initial position of locking pins 124 as depicted in FIGS. 13A to 13D. Consecutive, repeated cycling of lift cylinders 123 and shift cylinders 121 can result in a transverse movement of workover rig walking system 100 past wellhead 110, as shown in FIG. 12.

In some embodiments, as depicted in FIGS. 13A to 13D and in 14A to 14C, walking assemblies 105 can be affixed to main platform 101, base beam 103 and setback platform 111 by means of mounting flange 125. FIG. 13D illustrates a plurality of holes 130 disposed through mounting flange 125 that can allow for the multitude of rotational positions in which locking pins 124 can be affixed.

In some embodiments, roller raceway 126 can be mounted on top of walking foot 120 and can provide a secure surface for the movement of roller assembly 122.

Figure 15:
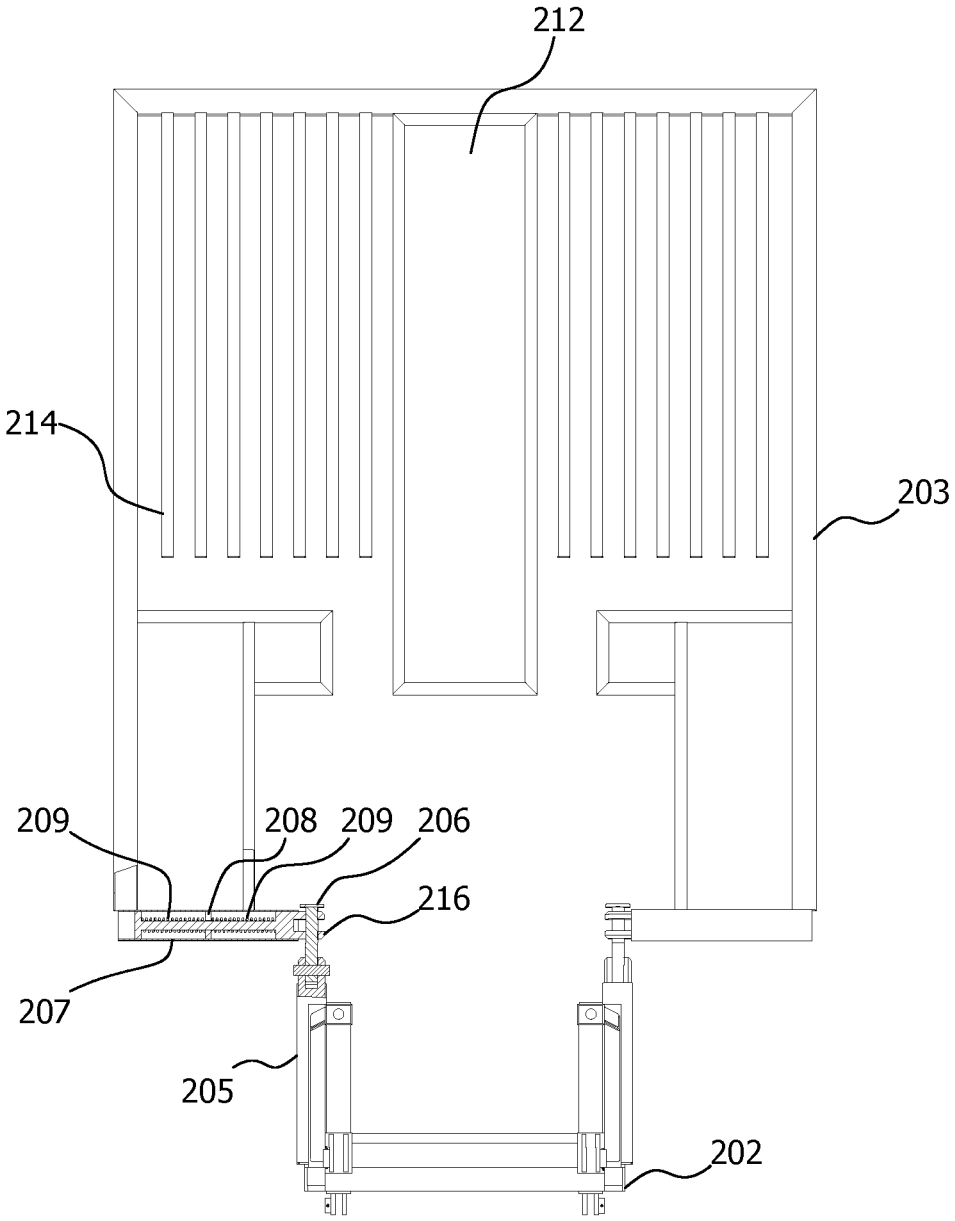
FIG. 15 is a top plan view depicting one embodiment of the upper racking board with isolators.
Figure 16:
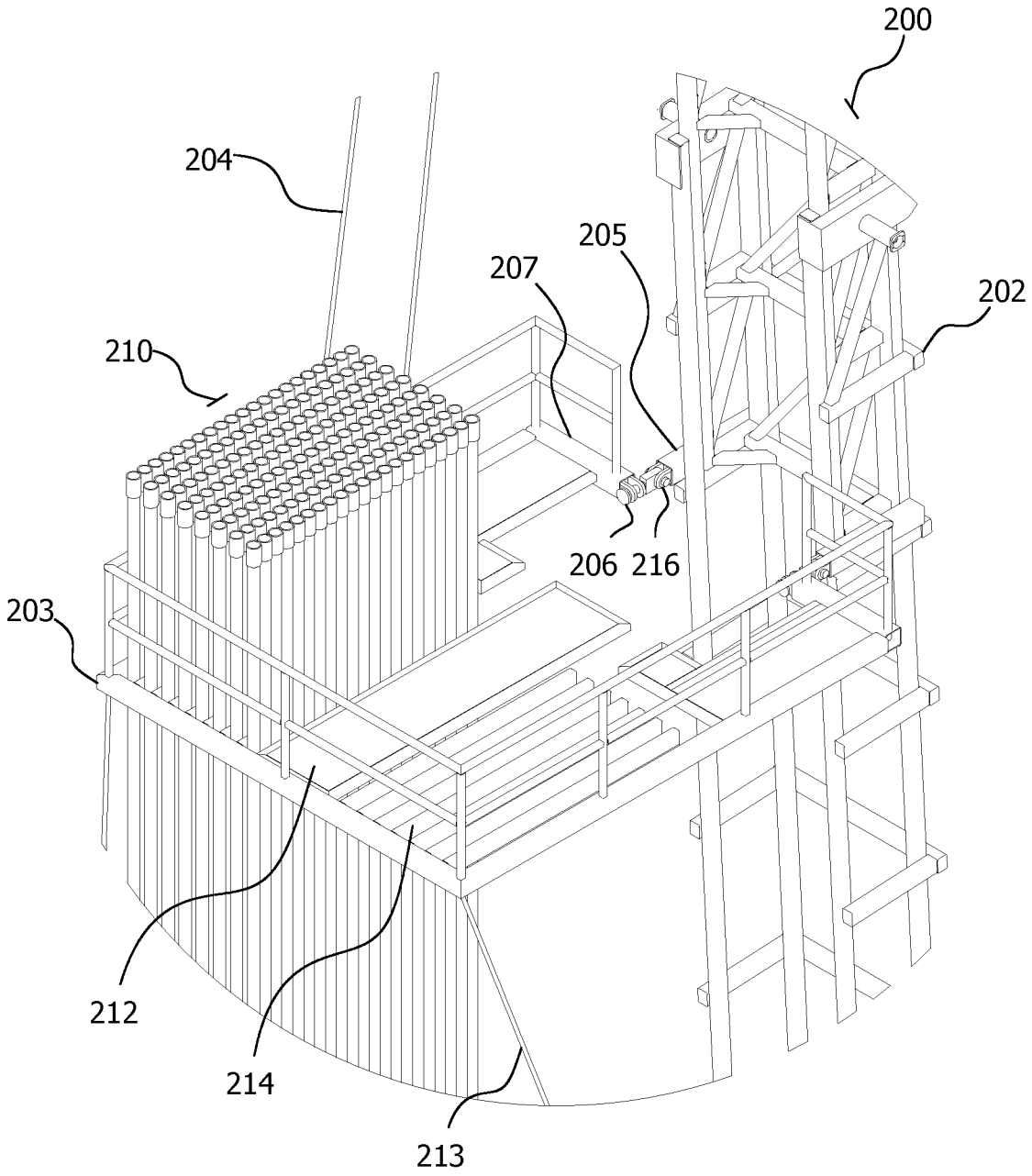
FIG. 16 is an isometric view depicting the upper racking board of FIG. 15.

Referring to FIGS. 15 and 16, one embodiment of upper racking board 203, which can comprise tubing spacers 214 and work platform 212. In some embodiments, upper racking board 203 can comprise racking board isolator 207 pinned to mast isolator 205 by means of knuckle pin 206. In some embodiments, one or both of racking board isolator and mast isolator 205 can be configured to limit the amount of force transmitted to mast 202. In some embodiments, one or more of the isolators can comprise one or more of a spring, a damper and a spring-damper combination, or other similar device as known to those skilled in the art to limit the amount of force transmitted to mast 202 by extending the duration of time that the restoring forces act when workover rig walking system 100 is moving workover rig 200.

In some embodiments, this isolation of upper racking board 203 from mast 202 can minimize acceleration loads from the movement of workstring 210 during operation of workover rig walking system 100. In some embodiments, racking board isolator 207 and mast isolator 205 can comprise fixed stop 208, spring dampers 209 and clevis 216, where spring dampers 209 can act on fixed stop 208 and clevis 216 to keep clevis 216 centralized when no external forces are applied to upper racking board 203. When an external force is applied to upper racking board 203, one spring damper 209 can compress while the opposite spring damper 209 can decompress. In some embodiments, spring dampers 209 can impart a specified force into mast 202 such that mast 202 will not be overloaded and fail. When the external force is removed, spring dampers 209 can equalize and return clevis 216 and upper racking board 203 to its original position.

Figure 17:
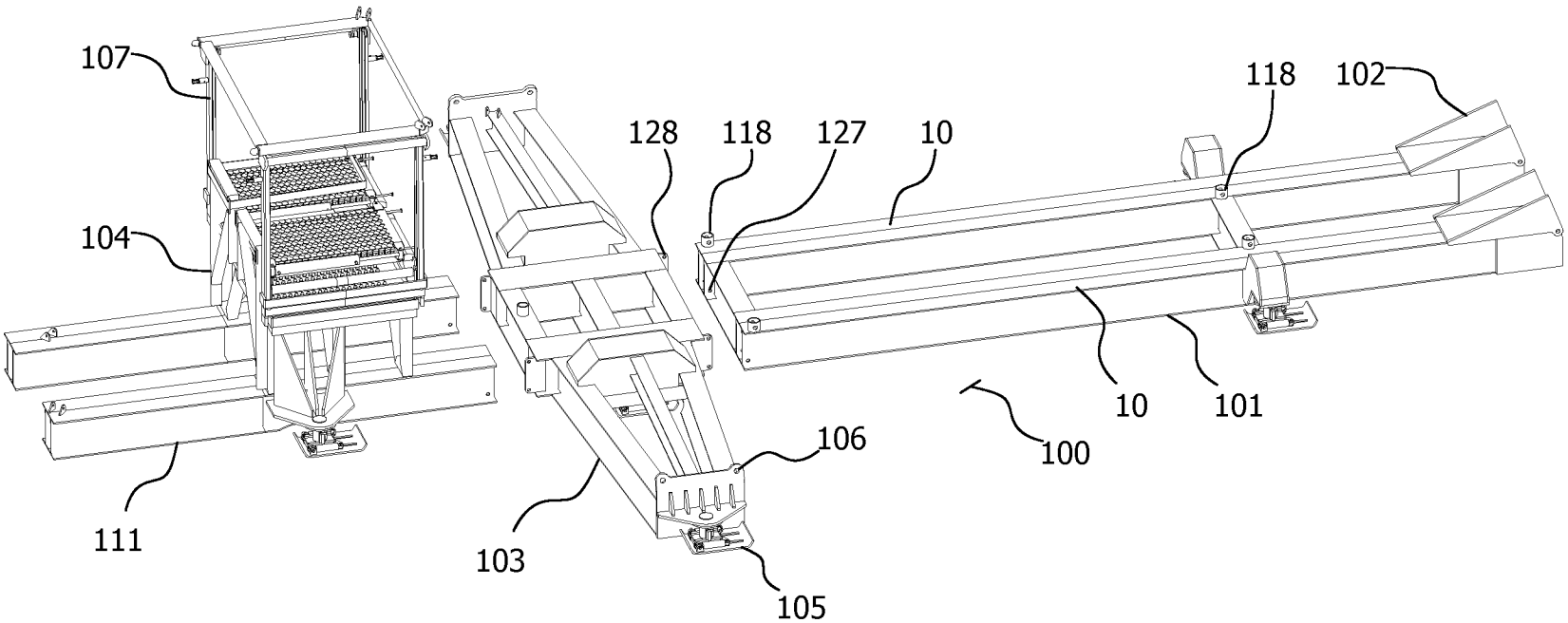
FIG. 17 is an isometric view depicting the workover rig walking system of FIG. 4 taken apart for transport.

Transportability of workover rig walking system 100 is of importance when moving from one site to another and can be achieved with the efficient separation of each sub-structure of the system. FIG. 17 shows one embodiment of the process for separating main platform 101, base beam 103 and setback platform 111. In some embodiments, each piece can be unpinned and separated into transportable loads by removing pins from lugs 128 that mate with sockets 127. Ramps 102 can be folded on top of main platform 101.

Figure 18A:
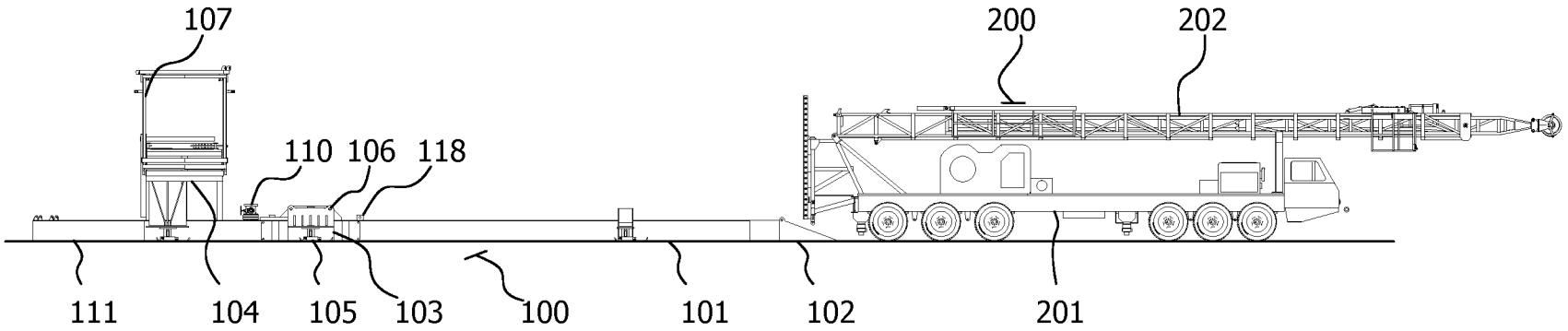
FIG. 18A is a side elevation view depicting the workover rig walking system of FIG. 2 approaching the ramp.
Figure 18B:
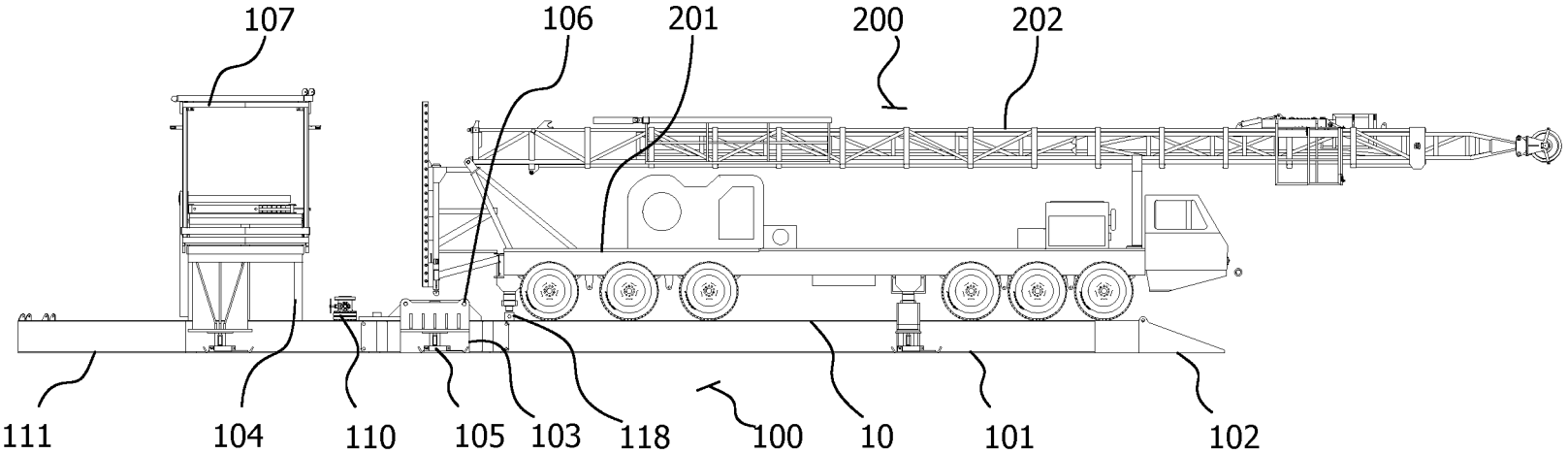
FIG. 18B is a side elevation view depicting the workover rig walking system of FIG. 18A in operating position.
Figure 18C:
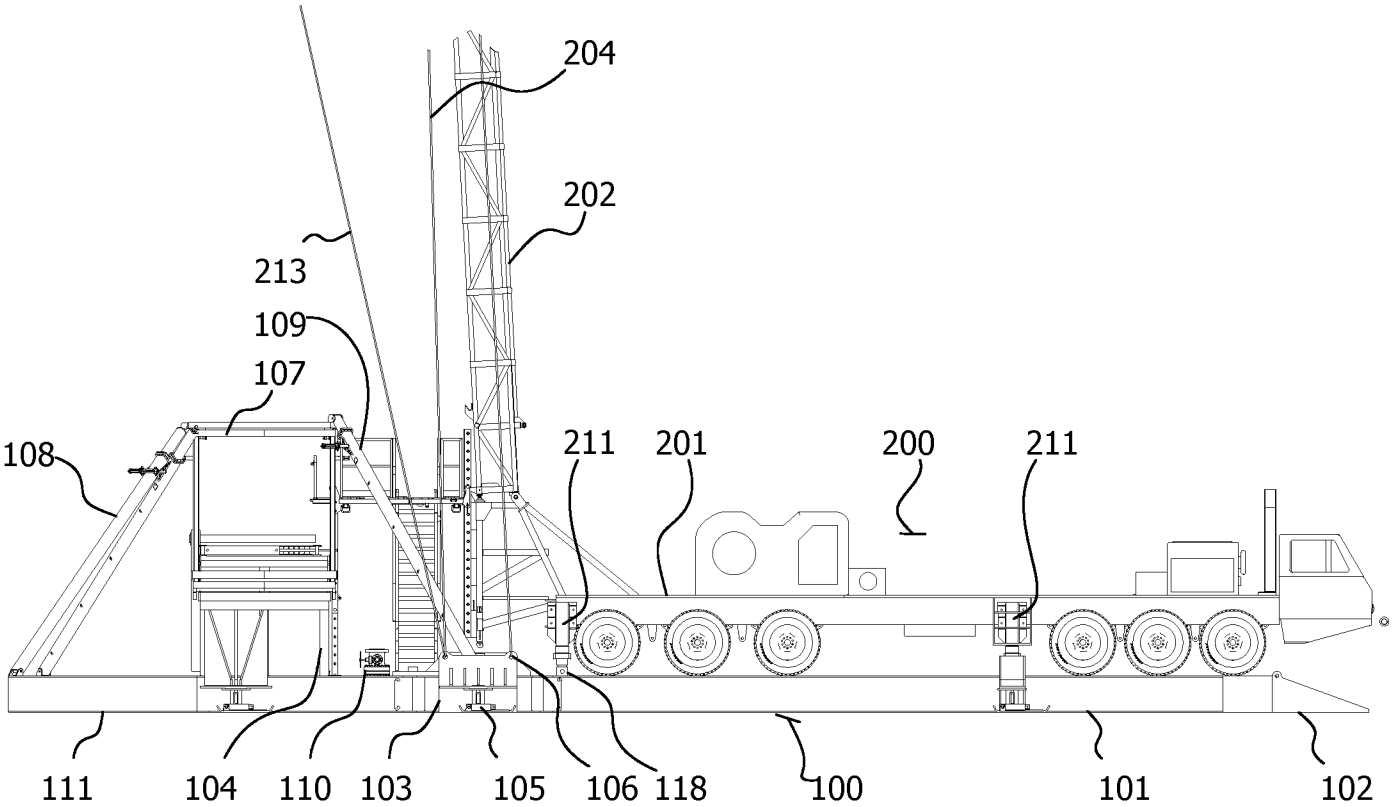
FIG. 18C is a side elevation view depicting the workover rig walking system of FIG. 18B in operating position with the mast raised.

Once workover rig walking system 100 is assembled and properly positioned in relation to wellhead 110, workover rig 200 can be positioned in front of system 100, moved onto main platform 101 and deployed as shown in FIGS. 18A to 18C, respectively. In some embodiments, workover rig 200 can comprise a plurality of leveling jacks 211, as shown in FIG. 18C, that can be pinned into sockets 118 affixed to main platform 101. Upon securing workover rig 200 to main platform 100, mast 202 can be raised to a working position. A plurality of mast guy-lines 204 and racking board guy-lines 213 can secure mast 202 and upper racking board 203 to guy anchor 106 disposed on base beam 103. In some embodiments, the securing of clamp frame 107 can be achieved by attaching rear supporting members 108 between setback platform 111 and clamp frame 107. In some embodiments, an additional set of front supporting members 109 can be pinned in place between base beam 103 and clamp frame 107.

Figure 19:
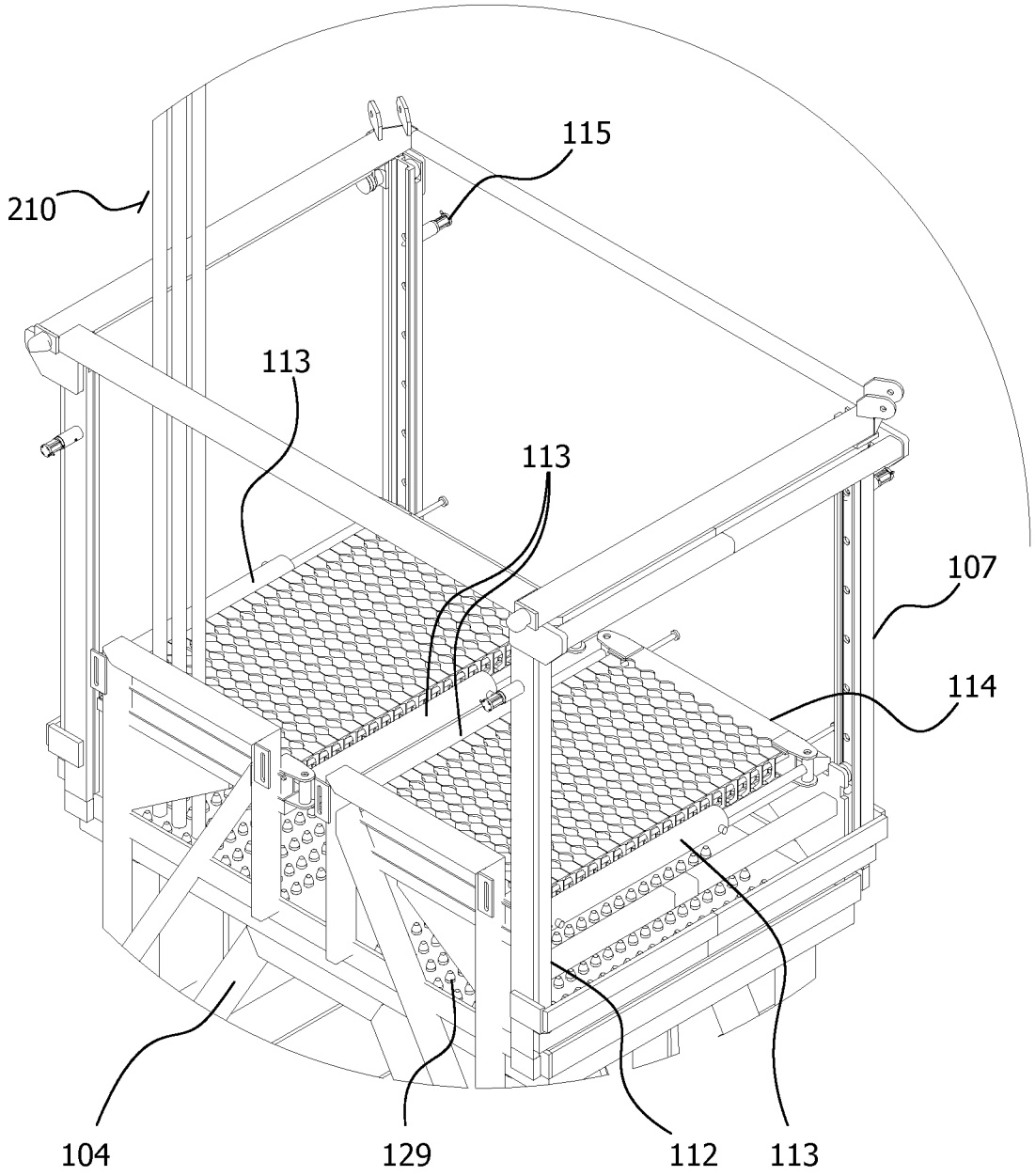
FIG. 19 is an isometric view depicting the lower racking area with tubing clamps in place.
Figure 20:
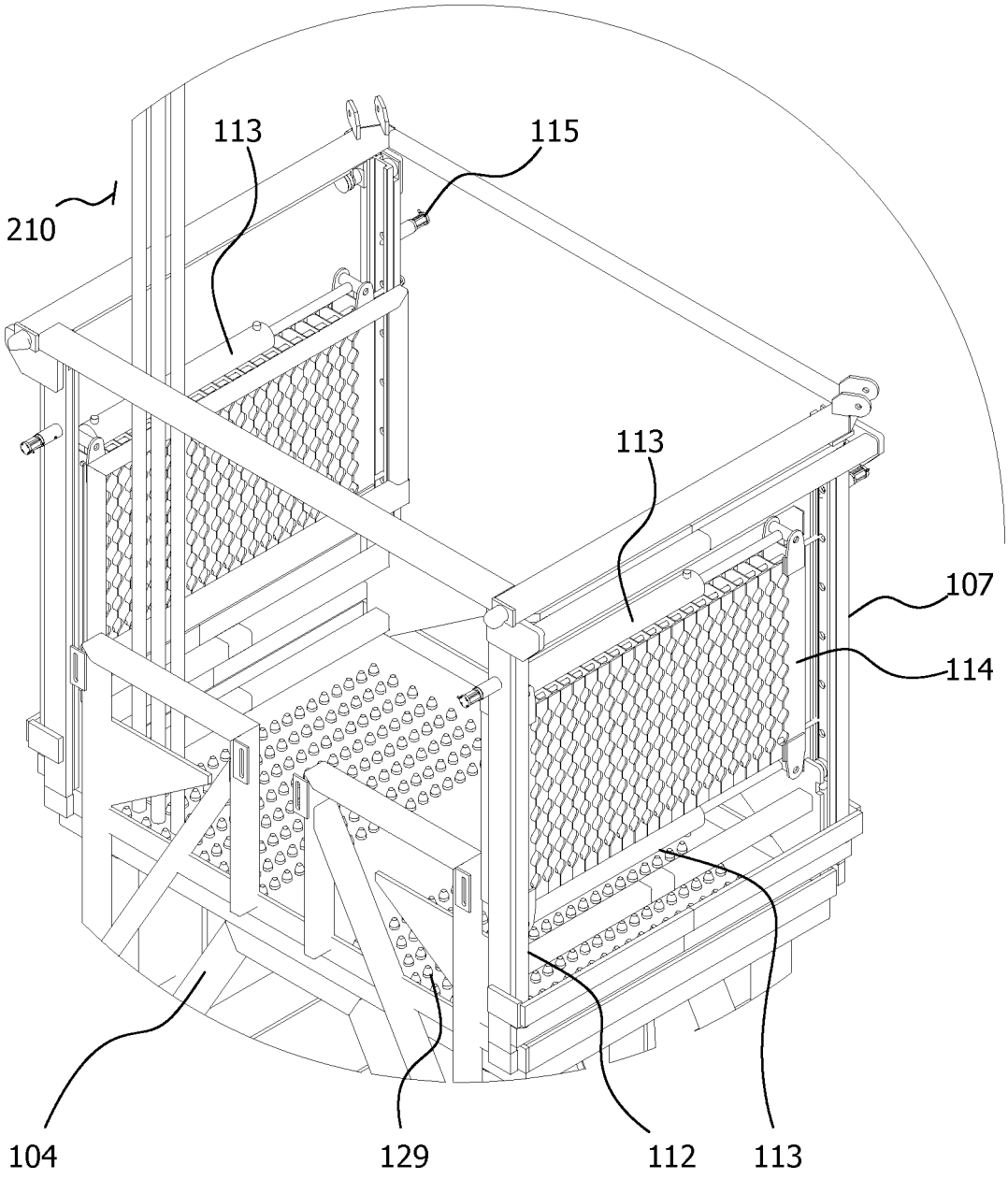
FIG. 20 is an isometric view depicting the lower racking area of FIG. 19 with tubing clamps in stand-by mode.
Figure 21:
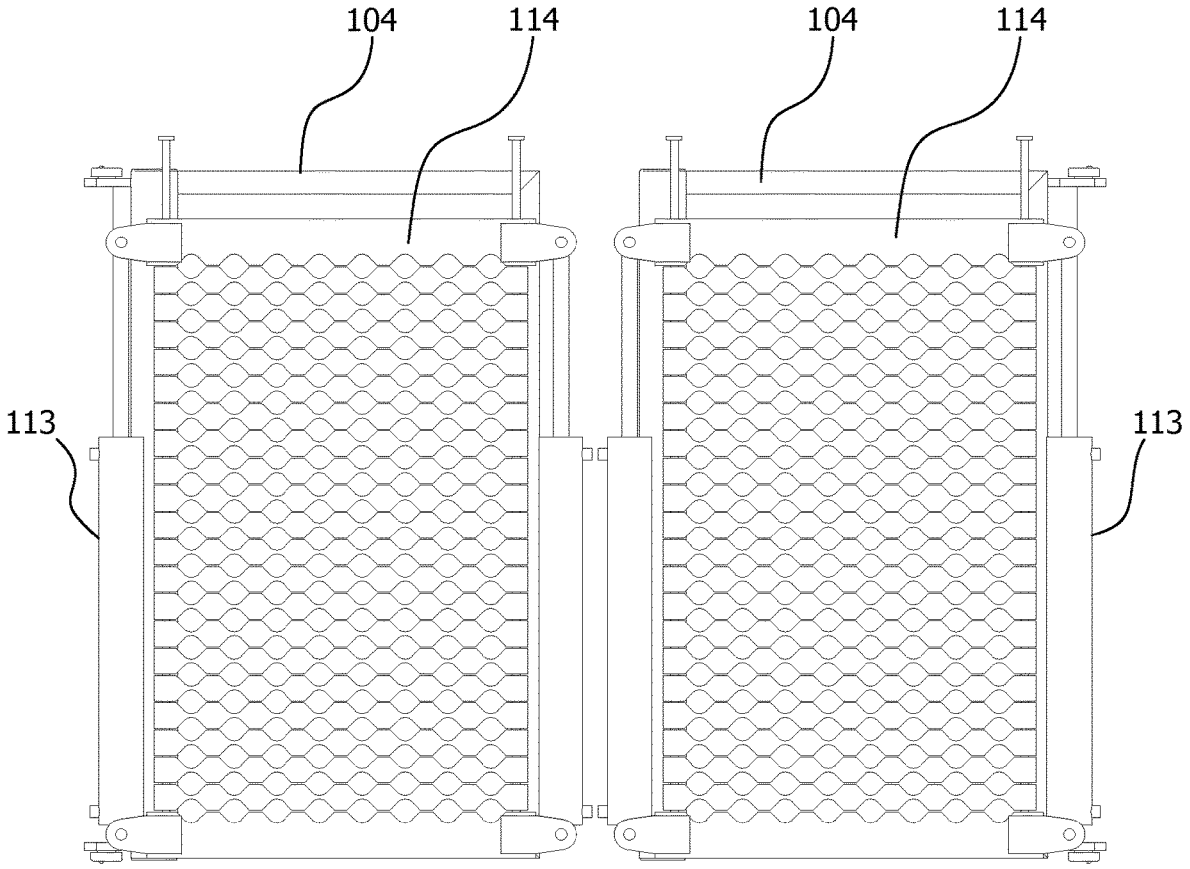
FIG. 21 is a top plan view depicting the lower racking area of FIG. 19.

Referring to FIGS. 19 to 21, one embodiment of the features and pieces that make up clamp frame 107 are shown. In some embodiments, a plurality of workstring clamps 114 can be deployed to maintain a consistent position of each workstring tubular prior to operating workover rig walking system 100. As workstring 210 is removed from wellhead 110, each section of workstring 210 can be placed on a locating pin 129 that can be disposed on setback platform 111. Upon complete withdrawal of workstring 210 from wellhead 110, frame cylinders 112 can extend vertically and can be locked in place with a plurality of locking cylinders 115. Clamping cylinders 113 can then be actuated to move workstring clamps 114 together and rigidly hold each individual workstring piece for the duration of the operation of workover rig walking system 100.

In some embodiments, clamping cylinders 113 and workstring clamps 114 can be rotated out of the way when workover rig 200 is being used in normal operation, as shown in FIG. 20.

Although a few embodiments have been shown and described, it will be appreciated by those skilled in the art that various changes and modifications can be made to these embodiments without changing or departing from their scope, intent or functionality. The terms and expressions used in the preceding specification have been used herein as terms of description and not of limitation, and there is no intention in the use of such terms and expressions of excluding equivalents of the features shown and described or portions thereof, it being recognized that the invention is defined and limited only by the claims that follow.

What is claimed:

1. A walking system for a workover rig or completion rig for use on a wellhead with a workstring assembled from a plurality of tubulars, the walking system for placement on a ground surface surrounding the wellhead, the workover rig or completion rig disposed on a motor vehicle, the workover rig or completion rig further comprising a mast and an upper racking board, the walking system comprising:

a main platform comprising vehicle tracks configured for the motor vehicle to travel along, the main platform configured for placement on the ground surface;

ramps disposed at a first end of the main platform, the ramps operatively coupled to the vehicle tracks, the ramps configured for the motor vehicle to travel up the ramps onto the vehicle tracks;

a set back platform disposed at a second end of the main platform, the set back platform comprising an elevated workstring platform wherein the elevated workstring platform is configured for storing the plurality of tubulars in combination with the upper racking board, the set back platform configured for placement on the ground surface;

a base beam disposed on the main platform between the first end and the second end of the main platform, the base beam comprising one end extending substantially perpendicularly from one side of the main platform, the base beam further comprising an opposing end extending substantially perpendicularly from an opposing side of the main platform, the base beam configured for placement directly on the ground surface to provide stability for the walking system; and a plurality of walking assemblies disposed on the main platform and on the one end and on the opposing end of the base beam, the plurality of walking assemblies configured to raise the combination of the walking system and the rig and move said combination in a lateral direction.

2. The walking system as set forth in claim 1, wherein the elevated workstring platform further comprises front supporting members and rear supporting members operatively coupled the elevated workstring platform to the main platform and the base beam, the front and rear supporting members configured to support the elevated workstring platform at a height above the wellhead.

3. The walking system as set forth in claim 1, wherein each of the ends of the base beam comprises a guy anchor configured for anchoring guy-lines from the mast and from the upper racking board.

4. The walking system as set forth in claim 3, further comprising mast guy-lines operatively coupling the mast to the guy anchors and racking board guy-lines operatively coupling the upper racking board to the guy anchors.

5. The walking system as set forth in claim 1, wherein each of the plurality of walking assemblies comprises:

a mounting flange operatively coupled to the main platform;

a lifting cylinder, an upper end of the lifting cylinder operatively coupled to the mounting flange;

a walking foot, the walking foot comprising a roller raceway; a roller assembly operatively coupled to a lower end of the lifting cylinder; and a shift cylinder operatively coupling the roller assembly to the walking foot, wherein the roller assembly travels along the roller raceway when the shift cylinder extends and retracts.

6. The walking system as set forth in claim 1, further comprising:

at least one racking board isolator disposed on the upper racking board;

at least one mast isolator disposed on the mast; and a coupler operatively coupling the at least one racking board isolator to the at least one mast isolator.

7. The walking system as set forth in claim 6, wherein one or both of the at least one racking board isolator and the at least one mast isolator comprises one or more of a spring, a damper and a spring-damper combination.

8. The walking system as set forth in claim 1, wherein the elevated workstring platform comprises a pipe stabilization system, comprising:

a clamp frame;

a plurality of workstring clamps configured to receive one or more of the tubulars; and a plurality of clamping cylinders operatively coupling the plurality of workstring clamps to the clamp frame, the plurality of clamping cylinders configured to tighten to clamp the tubulars to the clamp frame, the plurality of clamping cylinders further configured to loosen wherein the tubulars are released from the plurality of workstring clamps.

9. The walking system as set forth in claim 8, wherein the clamp frame further comprising a plurality of frame cylinders configured to raise and lower the clamp frame relative to the elevated workstring platform.

10. The walking system as set forth in claim 1, further comprising a plurality of leveling cylinders configured for leveling the main platform and the base beam.

* * * * *